US007442012B2

(12) United States Patent
Moens

(10) Patent No.: US 7,442,012 B2
(45) Date of Patent: Oct. 28, 2008

(54) SPEED CONTROL FOR COMPRESSORS

(75) Inventor: Erik Eric Daniël Moens, Maldegem (BE)

(73) Assignee: Atlas Copco Airpower, naamloze vennootschap, Wilrijk (BE)

( * ) Notice: Subject to any disclaimer, the term of this patent is extended or adjusted under 35 U.S.C. 154(b) by 278 days.

(21) Appl. No.: 10/524,116

(22) PCT Filed: Jul. 24, 2003

(86) PCT No.: PCT/BE03/00130

§ 371 (c)(1),
(2), (4) Date: Feb. 10, 2005

(87) PCT Pub. No.: WO2004/022977

PCT Pub. Date: Mar. 18, 2004

(65) Prior Publication Data

US 2005/0214128 A1 Sep. 29, 2005

(30) Foreign Application Priority Data

Sep. 3, 2002 (BE) ..... 2002/0514

(51) Int. Cl.
*F04B 49/00* (2006.01)
*F04B 49/02* (2006.01)
*F04B 49/10* (2006.01)

(52) U.S. Cl. ..... 417/32; 417/18; 417/22; 417/42; 417/53; 62/228.4; 318/461; 318/471; 388/800

(58) Field of Classification Search ..... 417/18, 417/22, 32, 42, 53; 318/254, 461, 471; 380/800; 62/228.4
See application file for complete search history.

(56) References Cited

U.S. PATENT DOCUMENTS

| | | | | |
|---|---|---|---|---|
| 4,662,185 | A * | 5/1987 | Kobayashi et al. | 62/228.4 |
| 4,897,798 | A * | 1/1990 | Cler | 700/276 |
| 5,782,608 | A | 7/1998 | McKee | |
| 6,416,290 | B1 * | 7/2002 | Yamauchi | 417/32 |
| 2002/0088241 | A1 | 7/2002 | Kazuya et al. | |
| 2003/0182952 | A1 * | 10/2003 | Brooke | 62/180 |

FOREIGN PATENT DOCUMENTS

DE 196 49 766 C 4/1998

* cited by examiner

*Primary Examiner*—Devon Kramer
*Assistant Examiner*—Leonard J Weinstein
(74) *Attorney, Agent, or Firm*—Bacon & Thomas, PLLC

(57) ABSTRACT

Improvements to a compressor which consists in that, as soon as the measured outlet temperature (TO) reaches a certain hysteresis upper temperature limit (HMAX), the actual rotational speed of the compressor element is either lowered with a speed jump (DS) when the measured rotational speed is situated in the higher speed range close to the maximum rotational speed (SMAX), or is increased with a speed jump (DS) when the measured rotational speed is situated in the lower speed range close to the minimum rotational speed (SMIN).

20 Claims, 3 Drawing Sheets

SPEED CONTROL FOR COMPRESSORS

BACKGROUND OF THE INVENTION

1. Field of the Invention

The present invention concerns some improvements to compressors.

2. Description of Related Art

In particular, the present invention concerns a compressor for compressing gases of the type comprising at least one compressor element with a gas outlet and a gas inlet, as well as a sensor to determine the outlet temperature in the gas outlet, a sensor to determine the rotational speed of the compressor element, a motor with an electronically adjustable speed driving this compressor element, and finally a control device for said motor.

It is known that such compressors can operate within a specific maximum speed range of the number of revolutions, between a maximum and a minimum number of revolutions which depends among others on the mechanical limitations of the rotating parts, whereby irrevocable damage can be caused to the compressor in case the number of revolutions exceeds said speed range.

The speed range is usually characterised by the ratio between the maximum number of revolutions and the minimum number of revolutions, whereby the value of this ratio is typically situated around 3.2.

It is also known that a further restriction of the speed range is imposed by a phenomenon caused by a drastic output reduction of a compressor in the high and low speed range, as a result of which, as the rotational speed of the compressor comes closer to the aforesaid maximum or minimum number of revolutions, the temperature of the compressed gas can raise to such an extent that the coatings of the compressor element and of the downstream parts of the compressor may be damaged by the heat. In practice, this occurs when the temperature on the outlet of the compressor element exceeds an admitted maximum critical threshold value of 260 to 265° C.

In order to restrict the influence of the output reduction and to prevent the temperature on the outlet of the compressor element from rising above the aforesaid threshold value, it is important to further restrict the above-mentioned admitted speed range, all the more when the circumstances having an influence on the temperature rise are more adverse, namely in case of high ambient temperatures, when the finishing quality of a new compressor is not so good, in case of increasing wear of a used compressor and the like.

Compressors of the above-mentioned type are already known which are equipped with a fixed speed limiter, in particular a speed limiter with a fixed minimum and maximum threshold value for the rotational speed, whereby the most adverse circumstances are taken as a basis to determine said fixed threshold values, namely for a compressor with a minimum production quality, a certain degree of wear and operating at a maximum admitted ambient temperature.

A disadvantage of such known compressors with a fixed speed limiter is that the set speed range which is determined on the basis of a worst case scenario, assuming the most adverse circumstances, is in fact too restricting for circumstances which are less adverse, such as for example in case of lower temperatures, allowing in principle for a higher speed range without exceeding the aforesaid maximum critical threshold value of the temperature on the outlet of the compressor element. This implies that the capacity of such a compressor cannot be used to the full as far as the delivered gas flow is concerned in circumstances which deviate from the aforesaid worst case scenario.

In practice, such known compressors have a speed range with a maximum/minimum rotational speed ratio in the order of magnitude of 2.4, whereas, under favourable conditions, a speed range of 3.2 would be possible.

The present invention aims to remedy the above-mentioned and other disadvantages by providing a compressor with a dynamic speed limiter which automatically maximizes the speed range of the compressor as a function of the operational circumstances, irrespective of the state and condition the compressor is in.

To this aim, the invention concerns an improvement to a compressor of the above-mentioned type which consists in that the compressor is provided with a dynamic speed limiter with what is called a hysteresis module, coupled to the above-mentioned control device of the motor and to the above-mentioned sensors for the outlet temperature and the rotational speed, whereby a hysteresis upper temperature limit and a hysteresis lower temperature limit have been defined in this hysteresis module, as well as an admitted maximum speed range which is determined by a minimum rotational speed and a maximum rotational speed and whereby, as soon as the measured outlet temperature reaches the specified hysteresis upper temperature limit, the actual rotational speed of the compressor element is lowered with a speed jump DS (i.e., an amount of speed change in RPM) when the measured rotational speed is situated in the high speed range close to the maximum rotational speed, or as soon as the measured gas outlet temperature reaches the specified hysteresis lower temperature limit, the actual rotational speed of the compressor element is increased with a speed jump DS when the measured rotational speed is situated in the low speed range close to the minimum rotational speed.

Thanks to the dynamic speed limiter according to the invention, when the aforesaid hysteresis upper temperature limit is reached, which preferably is somewhat lower, for example 2° C. lower than the admitted maximum critical threshold value of the outlet temperature, the rotational speed will automatically be adjusted in the right sense in order to make the outlet temperature decrease.

In this manner, the speed restriction is not determined by a worst case scenario, but under certain favourable circumstances, for example in case of low ambient temperatures, the rotational speed of the compressor will cover the entire speed range which is determined by the limitations of the rotating parts, such that the entire available capacity of the compressor as far as the gas output is concerned can be used completely. Should the circumstances become worse, for example when the ambient temperature rises, the speed range is automatically adjusted as soon as the outlet temperature reaches the aforesaid critical threshold value, such that this threshold value can never be exceeded, not even in case of increasing wear of the compressor.

In the hysteresis module is preferably also defined a hysteresis lower temperature limit whereby, as soon as the measured outlet temperature reaches the specified hysteresis lower temperature limit, the entire aforesaid admitted maximum speed range becomes available again.

This offers the advantage that when the operational conditions of the compressor become more favourable, as a result of which the temperature on the outlet of the compressor element decreases, the capacity of the compressor can be used to the full again.

The invention also concerns a method for compressing a gas whereby a compressor according to the invention is applied. As the operation of the compressor is optimized, there will be less unwanted failures of the compressor.

BRIEF DESCRIPTION OF THE DRAWINGS

In order to better explain the characteristics of the invention, the following preferred embodiment of the invention is described as an example only without being limitative in any way, with reference to the accompanying drawings, in which.

DETAILED DESCRIPTION OF THE EMBODIMENTS OF THE INVENTION

Figure 1:
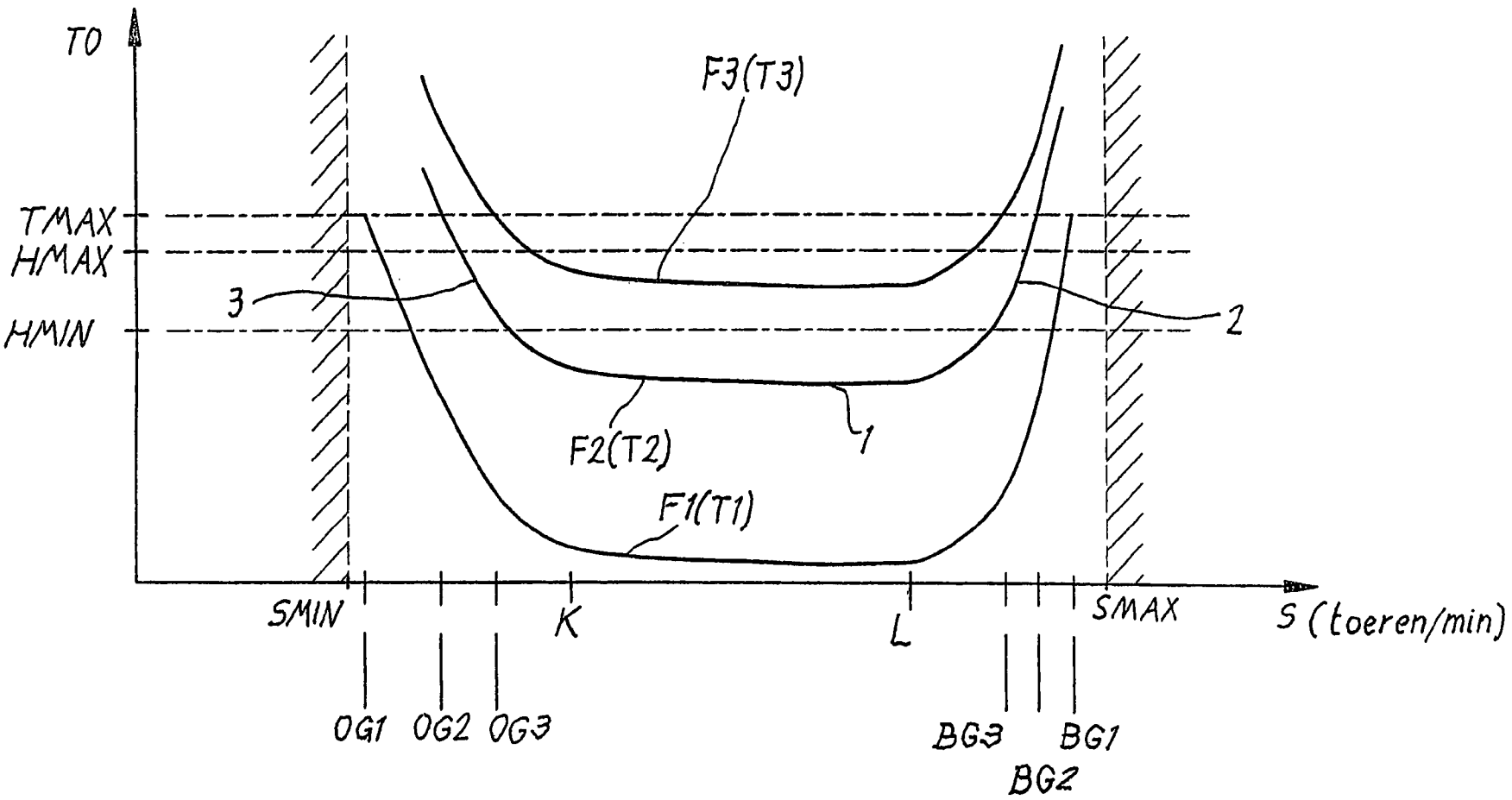
FIG. 1 represents the outlet temperature of a conventional compressor as a function of the rotational speed of the compressor.

FIG. 1 shows the temperature curve TO of the compressed gas on the outlet of the compressor element of a conventional compressor as a function of the number of revolutions S of the compressor, such for an admitted maximum speed range which is limited by an admitted minimum rotational speed SMIN and an admitted maximum rotational speed SMAX, whereby SMIN and SMAX are determined among others by the limits of the rotating parts.

FIG. 1 shows three outlet temperature curves, F1, F2 and F3 respectively, represented for three different ambient temperatures, namely a low temperature T1, a higher temperature T2 and a still higher temperature T3.

As can be clearly derived from this FIG. 1, each curve F1-F2-F3 has an almost flat middle part 1 with an almost constant outlet temperature for an ambient temperature that remains the same and two steeper parts, a part 2 in the high speed range of the compressor close to SMAX and a part 3 in the lower speed range close to SMIN respectively.

The parts 2 and 3 clearly illustrate the phenomenon whereby the compressor output strongly decreases and, consequently, the outlet temperature TO strongly increases, when the number of revolutions in the high speed range increases, decreases in the low speed range respectively.

The above-mentioned curves F1-F2-F3 are also a function of other parameters, such as among others the operational pressure, the finishing degree of a new compressor, the wear of a used compressor, whereby the curves shift upward for a compressor with a finishing that is less good or for a compressor which is more worn.

In order to keep the argumentation simple, we will assume hereafter that the latter parameters remain constant.

In FIG. 1 is also indicated the maximum critical threshold value TMAX of the outlet temperature TO above which the compressor must be stopped in order to prevent the coatings on the compressor element and on the downstream parts of the compressor to become damaged due to the excessive heat of the compressed gases.

It is clear that, because of this temperature threshold TMAX, the admitted speed range of the compressor at an ambient temperature Ti is limited by a lower threshold value OGi and an upper threshold value BG1. For the higher temperatures T2 and T3, the admitted (i.e., permitted) speed range of the compressor is smaller and will be situated between 0G2 and 0G3 respectively, and between BG2 and BG3 respectively.

With the known compressors, the most adverse situation at the highest admitted ambient temperature T3 is taken as a basis to determine the fixed speed range, and the fixed speed range is set between the corresponding lower and higher threshold values OG3 and BG3.

As opposed to such a conventional compressor with a fixed speed range OG3-BG3, a compressor according to the invention is provided with a dynamic speed limiter comprising a hysteresis module in which a hysteresis upper temperature limit HMAX is defined which is preferably 2° C. lower than TMAX and whereby, as soon as the measured outlet temperature TO reaches the specified hysteresis upper temperature limit, the actual rotational speed of the compressor element is either lowered with an adjustable speed jump DS when the measured rotational speed is situated in the higher speed range, or is increased with a speed jump DS when the measured rotational speed is situated in the lower speed range.

Figure 2:
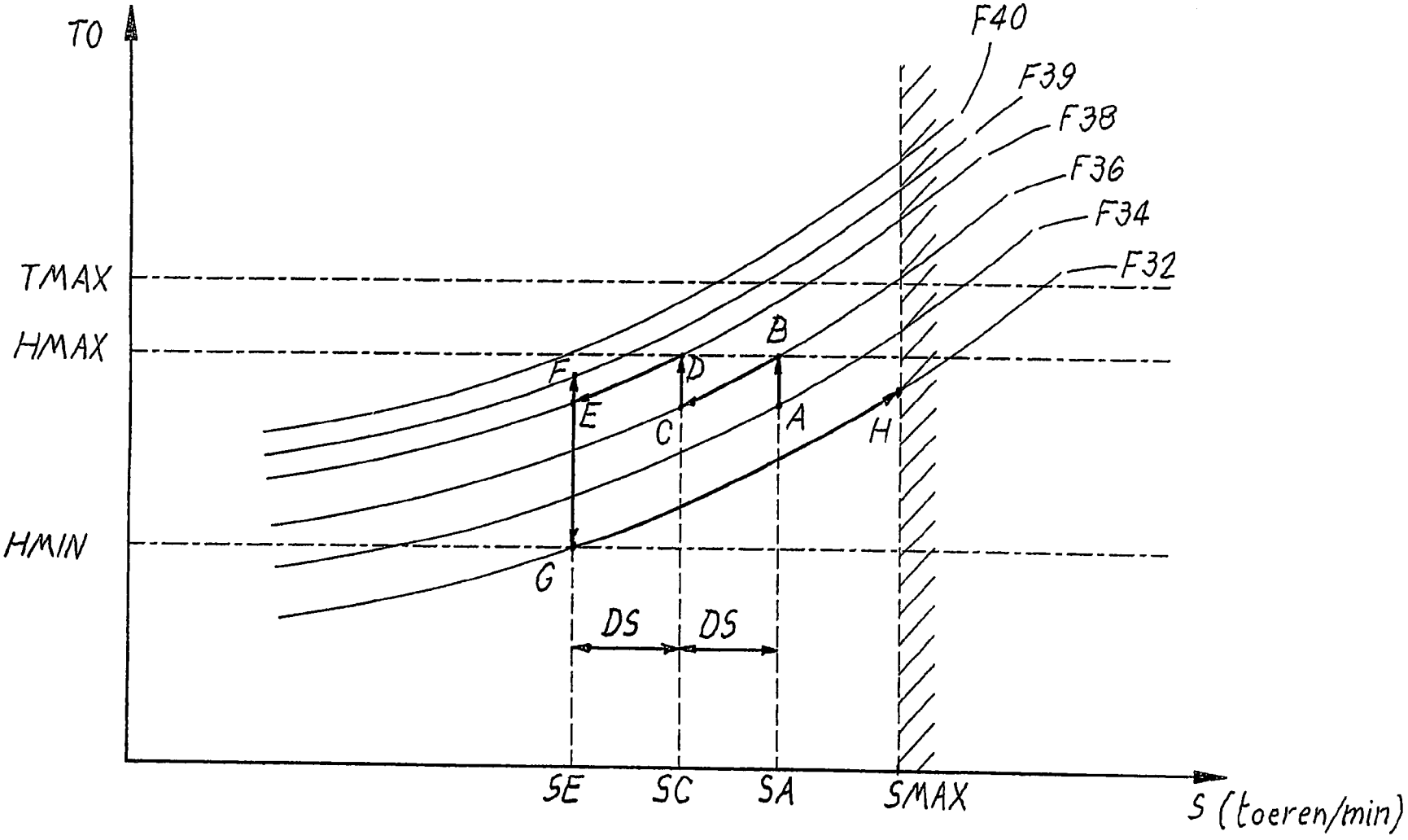
FIG. 2 represents the outlet temperature of a conventional compressor in the highest speed range of the compressor.

The working principle of a compressor with a dynamic speed limiter according to the invention is simple and will be illustrated hereafter by means of FIG. 2 representing a number of outlet temperature curves in the higher speed range of the compressor, such at different temperatures between 32° C. and 40° C.

If, for example, starting from a situation A at an ambient temperature of 34° C. and a number of revolutions SA, the ambient temperature gradually rises to 39° C., the number of revolutions of the compressor will first remain unchanged, and the outlet temperature TO will gradually rise up to the point where the operational point B reaches the hysteresis upper temperature limit HMAX and the hysteresis module instantly reduces the number of revolutions of the compressor according to the invention with a speed jump DS, as a result of which the operational point is immediately shifted to a point C, after which, when the ambient temperature rises still further, the outlet temperature will rise again at a constant number of revolutions SC until the upper temperature limit HMAX is reached again in point D and the hysteresis module applies an additional speed adjustment with a jump DS, such that the operational point immediately shifts to point E and afterwards, when the temperature rises still further to 39° C., will move further to point F on the curve F39 at a constant rotational speed SE.

It is clear that the maximum critical threshold value TMAX of the outlet temperature will never be reached in this case, and that the speed limits are automatically adjusted to less favourable circumstances, such as for example a higher ambient temperature, such that the speed limits must not be unnecessarily restricted, as is the case with conventional compressors, to a much smaller speed range, dictated by a hypothetical worst case situation.

According to the invention, also a hysteresis lower temperature limit HMIN is defined in the hysteresis module whereby, as soon as the measured outlet temperature TO reaches this lower temperature limit HMIN, the actual rotational speed of the compressor element is either increased when the measured rotational speed is situated in the highest speed range, or it is lowered when the measured rotational speed is situated in the lowest speed range.

The hysteresis module will preferably be configured such that, as soon as the measured outlet temperature TO reaches the hysteresis lower temperature limit HMIN, the entire above-mentioned admitted maximum speed range between SMIN and SMAX becomes available again.

If, starting from the preceding operational point F, the ambient temperature decreases to for example 32° C., the number of revolutions SE will at first remain constant and the outlet temperature TO will drop until HMIN is reached, and the hysteresis module will make an upward adjustment of the rotational speed of the compressor according to the invention until the admitted maximum number of revolutions SMAX and thus a maximum delivery is reached in the operational point H on the curve F32, or until the upper temperature limit HMAX is reached should this occur any sooner.

A similar regulation principle occurs in the lowest speed range of the compressor close to the minimum rotational speed SMIN, whereby the speed is now each time increased with a speed jump DS when the hysteresis upper temperature limit HMAX is reached. This means that the delivery pressure of the compressor will rise up to an automatic idle condition and possibly to an automatic stop/restart mode of the compressor, without switching to an unwanted stop mode with alarm and manual re-start. In other words, the speed at which the compressor runs idle is adjusted as a function of the ambient temperature and the condition of the compressor.

The above-mentioned speed jump DS is preferably set such that a resulting decrease of the outlet temperature TO is always smaller than the difference between the hysteresis upper temperature limit HMAX and the hysteresis lower temperature limit HMIN in order to avoid cyclic instable behaviour of the rotational speed of the compressor.

The outlet temperature TO is measured at a certain frequency, for example once in a minute.

In case of a sudden rise of the ambient temperature, this measuring frequency may be too low in order to be able to adjust the speed range sufficiently fast. That is why, when the measured outlet temperature TO is still higher than the hysteresis upper temperature limit HMAX after a speed adjustment with a jump DS, the measuring frequency will be raised, such that the hysteresis module can react faster and possibly with several successive jumps DS until the outlet temperature drops below HMAX.

The dynamic speed limiter is preferably provided with safety devices, for example in order to prevent that the speed exceeds an admitted maximum speed SMAX and/or in order to prevent that the speed drops below an admitted minimum speed SMIN and/or in order to prevent that the admitted maximum critical outlet temperature TMAX is exceeded during a certain time, etc.

The dynamic speed limiter is preferably programmed in order to obtain an almost optimal operation of the compressor with a speed range larger than 2.5, preferably between 2.7 and 3.5, and it can be adjusted such that at least the admitted maximum critical outlet temperature TMAX can be set, preferably between 150° C. and 350° C., better still between 200° C. and 300° C.

Figure 3:
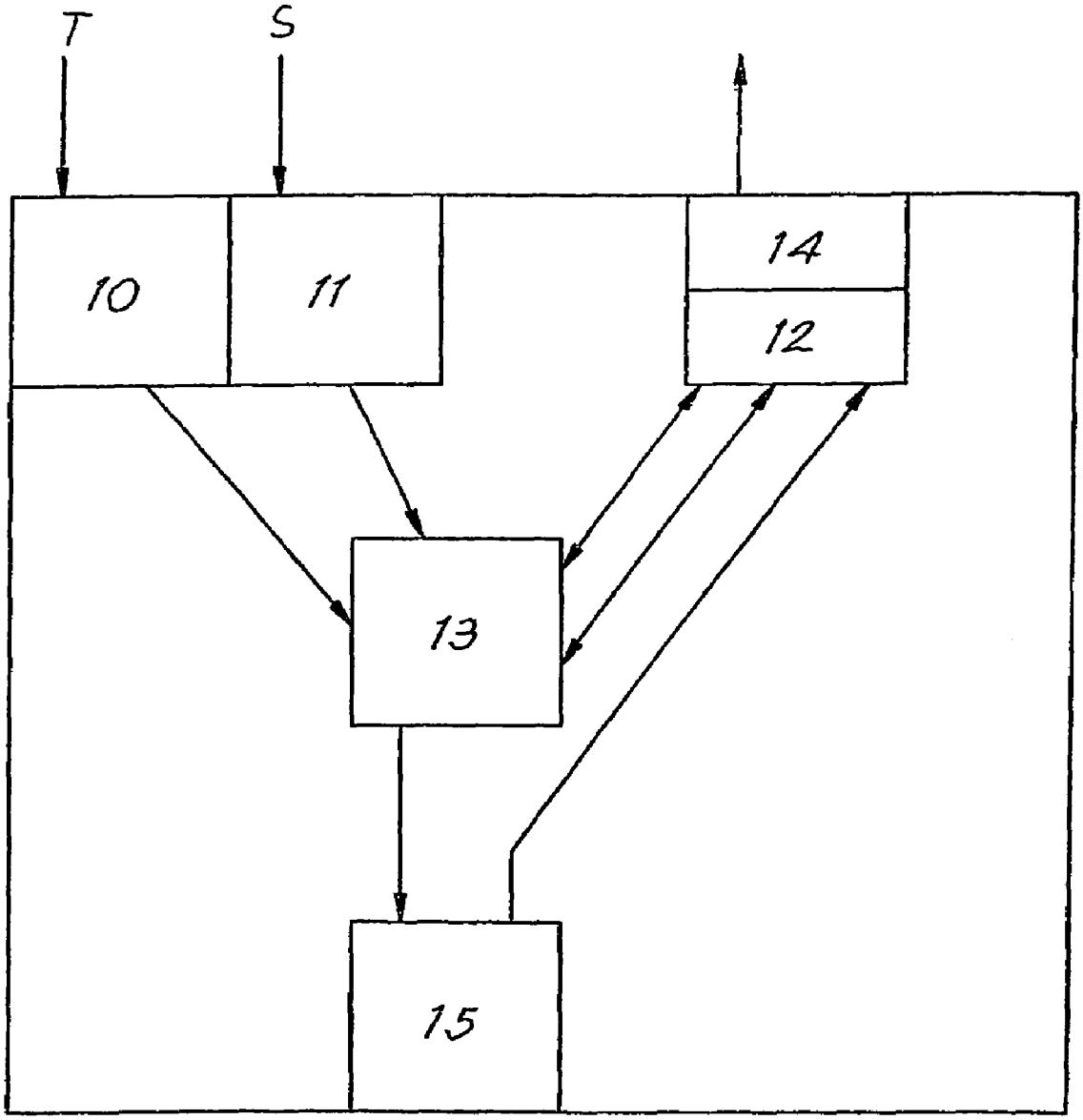
FIG. 3 represents a module of a speed regulation according to the invention.

FIG. 3 schematically shows a dynamic speed limiter according to the invention.

This speed limiter comprises:

a means 10 for receiving a an outlet temperature TO signal from the temperature sensor;

a means 11 for receiving a signal from the rotational speed sensor of the compressor;

a control device 12 for regulating the speed of the motor which drives the rotating element of the compressor, for example as a function of the load of the compressor element, within a specified maximum speed range (SMIN-SMAX), determined by limitations on the rotating parts;

a hysteresis module 13 for adjusting the speed as a function of the signals (outlet temperature TO and number of revolutions S) of the means 10 and the means 11, whereby this hysteresis module 13 may have a memory with possibly a number of outlet temperature curves and/or whereby this hysteresis module 13 may be programmed in the control device 12;

a safety means 14 to stop the compressor, for example as soon as the outlet temperature TO exceeds a maximum critical threshold temperature TMAX;

a memory 15 for a minimum speed, whereby this minimum speed is used as the initial speed to set the compressor back to work after it has run idle, and whereby this minimum speed corresponds to the minimum speed after the last speed adjustment by the hysteresis module 13 in the lower rotational speed range of the compressor or with a minimum speed of 1500 to 2000 revolutions per minute (the minimum speed may also be a speed which is higher than the latter minimum speed, for example which is 10 to 30% higher than the latter minimum speed, with a minimum of 1750 revolutions per minute). The memory also contains the speed values which define the lower, higher speed zone respectively (SMJN-K and L-SMAX) where the dynamic speed adjustment applies. In the intermediate speed zone, the control does not apply. As soon as the outlet temperature TO reaches the HMAX value, it is determined in what speed zone the actual speed is situated, in order to thus implement the required speed adjustment, i.e. a speed increase, a speed decrease respectively, depending on whether the speed is situated in the lower speed zone (SMIiN-K), the higher speed zone (L-SMAX) respectively.

The invention claimed is:

1. A dynamic speed limiter for a compressor, said compressor having a compressor element with a gas inlet and a gas outlet, a temperature sensor arranged to determine the outlet temperature in the gas outlet, a speed sensor arranged to determine the rotational speed of the compressor element, a motor driving the compressor with adjustable speed, and a speed control device for the motor, wherein said dynamic speed limiter comprises:

a hysteresis module coupled to the speed control device and to the temperature and speed sensors, wherein the hysteresis module is configured with a hysteresis upper temperature limit, a hysteresis lower temperature limit, and a permitted maximum speed range including a minimum rotational speed and a maximum rotational speed, wherein upon detecting from the temperature sensor that the hysteresis upper temperature limit of the outlet gas has been reached, the hysteresis module is configured to lower the rotational speed of the compressor element by a speed change via the speed control device when the measured rotational speed of the compressor element is in a high speed range appoximately at the compressor element maximum rotational speed, and wherein upon detecting from the temperature sensor that the hysteresis upper temperature limit of the outlet gas has been reached, the hysteresis module is configured to lower the rotational speed of the compressor element by a speed change via the speed control device when the measured rotational speed of the compressor element is in a low speed range approximately at the compressor element minimum rotational speed; and further wherein upon detecting from the temperature sensor that the specified hysteresis lower temperature limit is reached, the hysteresis module is configured to raise the rotational speed of the compressor element via the speed control device when the measured rotational speed is in an upper speed range approximate to the maximum compressor element rotational speed, and wherein the hysteresis module is configured to lower the rotational speed of the compressor element when the measured rotational speed is in a lower speed range approximately at the compressor element minimum rotational speed, and, wherein the hysteresis module is configured such that an increase of the rotational speed resulting from a hysteresis upper temperature limit being detected in the lower speed range of the compressor resulting in an increase of the operational pressure, results in an automatic idle condition of the compressor element.

2. The dynamic speed limiter according to claim 1, wherein the hysteresis upper temperature limit is lower than a maximum critical threshold value of the outlet temperature above which compressor damage can occur.

3. The dynamic speed limiter according to claim 1, wherein, upon detecting from the temperature sensor that the specified hysteresis lower temperature limit of the outlet gas is reached, the hysteresis module is configured to raise the rotational speed of the compressor element via the speed control device when the measured rotational speed is in an upper speed range approximate to the maximum compressor element rotational speed, and wherein the hysteresis module is configured to lower the rotational speed of the compressor element when the measured rotational speed is in a lower speed range approximately at the compressor element minimum rotational speed.

4. The dynamic speed limiter according to claim 3, wherein the hysteresis module is configured to affect the speed control device to enable the compressor element to operate in the maximum permitted speed range when it detects from the temperature sensor that the outlet temperature has reached the hysteresis lower temperature limit.

5. The dynamic speed limiter according to claim 1, wherein the speed change is adjustable when the hysteresis upper temperature limit is reached.

6. The dynamic speed limiter according to claim 3, wherein the speed change is adjustable such that a resulting decrease of the outlet temperature is smaller than the difference between the hysteresis upper temperature limit and the hysteresis lower temperature limit to avoid cyclic instable behaviour of the rotational speed of the compressor element.

7. The dynamic speed limiter according to claim 1, wherein the hysteresis module is configured to receive a measurement of the outlet temperature with a certain periodicity.

8. The dynamic speed limiter according to claim 7, wherein the hysteresis module is configured such that the periodicity of the measurements of the outlet temperature is increased when the outlet temperature exceeds the hysteresis upper temperature limit.

9. The dynamic speed limiter according to claim 1, wherein the control device for the motor includes at least one safety device in order to prevent extreme conditions.

10. The dynamic speed limiter according to claim 1 configured to operate the compressor optimally with a speed ratio larger than 2.5.

11. The dynamic speed limiter according to claim 1, wherein a maximum critical threshold value of the outlet temperature is adjustable between 150° C. and 350° C.

12. A method for controlling a compressor having a dynamic speed limiter, said compressor having a compressor element with a gas inlet and a gas outlet, a temperature sensor to determine the outlet temperature in the gas outlet, a speed sensor to determine the rotational speed of the compressor element, a motor with adjustable speed driving the compressor, and a speed control device for the motor, comprising:

providing the dynamic speed limiter with a hysteresis module, the hysteresis module being coupled to the speed control device and to the sensors for the outlet temperature and the rotational speed;

detecting the gas outlet temperature of the compressor element;

configuring the hysteresis module with a hysteresis upper temperature limit, a hysteresis lower temperature limit, and a permitted maximum speed range within a compressor element minimum rotational speed and a maximum rotational speed;

when the gas outlet temperature reaches the specified hysteresis upper temperature limit, causing the hysteresis module to lower the rotational speed of the compressor element via the speed control device by a speed change when the measured rotational speed is in a high speed range approximately at the maximum rotational speed, when the gas outlet temperature reaches the specified hysteresis upper temperature limit, causing the hysteresis module to increase the rotational speed of the compressor element by a speed change when the measured rotational speed is in a low speed range approximately at the minimum rotational speed and further when the gas outlet temperature reaches the specified hysteresis lower temperature limit, causing the hysteresis module to raise the rotational speed of the compressor element via the speed control device when the measured rotational speed of the compressor element is in an upper speed range approximate to the maximum compressor element rotational speed, and lowering the rotational speed of the compressor element when the measured rotational speed is in a lower speed range approximately at the compressor element minimum rotational speed, and, when the increase of the rotational speed resulting from a hysteresis upper temperature limit being detected in the lower speed range of the compressor resulting in an increase of the operational pressure, results in an automatic idle condition of the compressor element.

13. A dynamic speed limiter for a compressor, said compressor having a compressor element with a gas inlet and a gas outlet, a temperature sensor arranged to determine the outlet temperature in the gas outlet, a speed sensor arranged to determine the rotational speed of the compressor element, a motor driving the compressor with adjustable speed, and speed a control device for the motor, wherein said dynamic speed limiter comprises:

a hysteresis module coupled to the speed control device and to the temperature and speed sensors, wherein the hysteresis module is configured with a hysteresis upper temperature limit, a hysteresis lower temperature limit, and a permitted maximum speed range including a minimum rotational speed and a maximum rotational speed, wherein upon detecting from the temperature sensor that the hysteresis upper temperature limit of the outlet gas has been reached, the hysteresis module is configured to lower the rotational speed of the compressor element by a speed change via the speed control device when the measured rotational speed of the compressor element is in a high speed range approximately at the maximum rotational speed;

wherein upon detecting from the temperature sensor that the hysteresis upper temperature limit of the outlet gas has been reached, the hysteresis module is configured to increase the rotational speed of the compressor element by a speed change via the speed control device when the measured rotational speed of the compressor element is in a low speed range approximately at the minimum rotational speed, and further wherein upon detecting from the temperature sensor that the specified hysteresis lower temperature limit is reached, the hysteresis module is configured to raise the rotational speed of the compressor element via the speed control device when the measured rotational speed is in an upper speed range approximate to the maximum compressor element rotational speed, and wherein the hysteresis module is configured to lower the rotational speed of the compressor element when the measured rotational speed is in a lower speed range approximately at the compressor element minimum rotational speed, and, wherein the hysteresis module is configured such that an increase of the rotational speed resulting from a hysteresis upper temperature limit being detected in the lower speed range of the compressor element resulting in an increase of the operational pressure, results in an automatic idle condition of the compressor element, and wherein the hysteresis module is further configured with a memory for storing gas outlet temperature curves representing the outlet temperature as a function of the rotational speed of the compressor element and the hysteresis upper and lower temperature limits, and a speed jump for the rotational speed that is effected when the hysteresis upper or the lower temperature limit is reached.

14. The dynamic speed limiter according to claim 13, wherein the hysteresis module is further configured to determine from the speed sensor whether the rotational speed of the compressor element is situated in the low speed range or in the high speed range in order to effect the correct speed adjustment when the hysteresis upper temperature limit is reached.

15. The dynamic speed limiter according to claim 13 further comprising a memory configured to provide an automatic re-start at a same speed as when the compressor was running idle before.

16. The dynamic speed limiter according to claim 7, wherein the hysteresis module is configured to receive a measurement of the gas outlet temperature at least once per minute.

17. The dynamic speed limiter according to claim 1, wherein the hysteresis module is configured to receive a measurement of the gas outlet temperature continuously.

18. The dynamic speed limiter according to claim 10, wherein the dynamic speed limiter is configured to operate the compressor with a speed ratio between 2.7 and 3.5.

19. The dynamic speed limiter according to claim 11, wherein the maximum critical threshold value of the outlet temperature is adjustable between 200° C. and 300° C.

20. The dynamic speed limiter according to claim 2, wherein the hysteresis upper temperature limit is less than the critical maximum threshold value by 2° C. or less.

* * * * *